US005124733A

United States Patent [19]

Haneishi

[11] Patent Number: 5,124,733

[45] Date of Patent: Jun. 23, 1992

[54] STACKED MICROSTRIP ANTENNA

[75] Inventor: Misao Haneishi, Urawa, Japan

[73] Assignees: Saitama University, Department of Engineering; Seiko Instruments Inc., Japan

[21] Appl. No.: 492,635

[22] Filed: Mar. 13, 1990

[30] Foreign Application Priority Data

Apr. 28, 1989 [JP] Japan ..... 1-110449

[51] Int. Cl.[5] ..... H01Q 1/38

[52] U.S. Cl. ..... 343/700 MS; 343/846

[58] Field of Search ..... 343/700 MS, 829, 830, 343/846

[56] References Cited

U.S. PATENT DOCUMENTS

| | | | |
|---|---|---|---|
| 4,089,003 | 5/1978 | Conroy | 343/700 MS |
| 4,162,499 | 7/1979 | Jones et al. | 343/700 MS |
| 4,218,682 | 8/1980 | Yu | 343/700 MS |
| 4,329,689 | 5/1982 | Yee | 343/700 MS |

FOREIGN PATENT DOCUMENTS

| | | | |
|---|---|---|---|
| 41205 | 2/1986 | Japan . | |
| 2147744 | 5/1985 | United Kingdom | 343/700 MS |
| 2198290 | 6/1988 | United Kingdom . | |

*Primary Examiner*—Michael C. Wimer

*Attorney, Agent, or Firm*—Bruce L. Adams; Van C. Wilks

[57] ABSTRACT

The stacked microstrip antenna has a ground plane, a first dielectrical layer, a first radiating element, a second dielectric layer, a second radiating element and a short-circuiting conductor for short-circuiting between the first and second radiating elements and the ground plane. The stacked microstrip antenna attains double-channel duplex characteristics with utilizing the coupling between the first radiating element and the second radiating element, when a power is fed to the antenna. Further, the widthwise dimension of the short-circuiting conductor is controlled, whereby the antenna leads to the miniaturization of the radiating elements, namely, the miniaturization of an antenna proper, and it is permitted to be tuned to two desired frequencies with ease.

2 Claims, 3 Drawing Sheets

STACKED MICROSTRIP ANTENNA

BACKGROUND OF THE INVENTION

1. Field of the Invention

The present invention relates to a miniature stacked microstrip antenna of wide band in radio communication apparatus.

2. Description of the Prior Art

Conventionally, a standard microstrip antenna consists of a ground plane, a radiating element and a dielectric layer sandwiched between them. When a high-frequency voltage is supplied between the ground plane and the radiating element, the antenna has a resonance frequency decided by an effective wavelength ($\lambda$) in the dielectric layer. In this case, the radiating element is formed by a square having a side of $\lambda/2$.

Furthermore, a microstrip antenna which short-circuits one whole edge of the radiating element with the ground plane in the standard microstrip antenna is known. The microstrip antenna can get the same resonance frequency as that of the standard microstrip antenna with an open area which is ½ or less.

With the antennas as stated above, the resonance frequencies are determined by the dimensions of the radiating elements and the dimentions between the ground plane and the radiating elements.

Therefore, the antennas have the disadvantage that it is difficult of being made still smaller in size as may be needed. Specially, the antennas become a large open area when they need a low resonance frequency.

As another disadvantage, in a case where deviations have occurred between designed resonance frequency and the resonance frequency of the fabricated antenna, the dimension of the radiating element must be changed, and the correction of the resonance frequency is difficult.

SUMMARY OF THE INVENTION

An object of the present invention is to provide a stacked microstrip antenna having two resonance frequencies and being a miniature size.

Another object of the present invention is to provide a stacked microstrip antenna capable of controlling resonance frequencies easy.

To realize above objects, the stacked microstrip antenna of the present invention has a ground plane, a first dielectric layer formed on the ground plane, a first radiating element formed on the first dielectric layer, a second dielectric layer formed on the first radiating element, a second radiating element formed on the second dielectric layer, a short-circuiting conductor which short-circuits the first and second radiating elements with the ground plane, and a feeder for feeding power to one of the first and second radiating elements.

The stacked microstrip antenna can attain double-channel duplex characteristics in utilizing a coupling between the first and second radiating elements.

The short-circuiting conductor is equivalent to loading with an inductance, so that the short-circuiting conductor leads to lowering in the resonance frequencies. Therefore, the stacked microstrip antenna can achieve the miniaturization of the antenna.

Further, the stacked microstrip antenna can control the resonance frequencies with changing the widthwise dimension of the short-circuiting conductor.

DESCRIPTION OF THE PREFERRED EMBODIMENT

The present invention will now be described with reference to the accompanying drawings representing and embodiment thereof.

Figure 1:
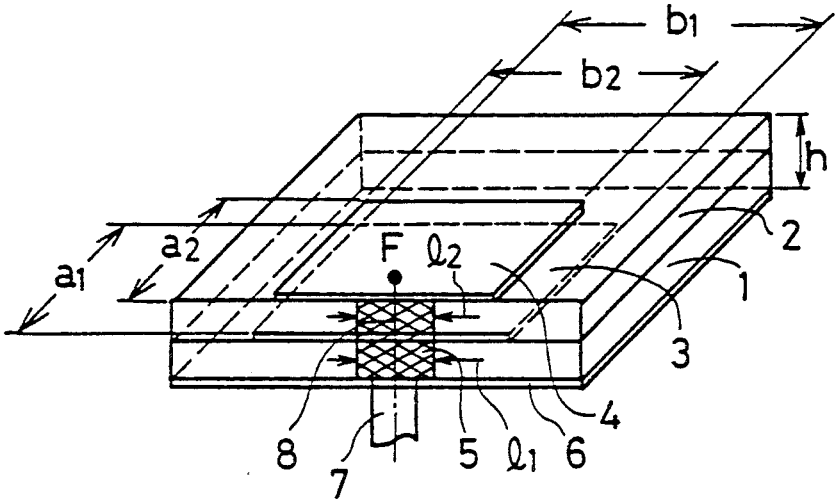
FIG. 1 is a perspective view illustrating an embodiment of the present invention.
Figure 2:
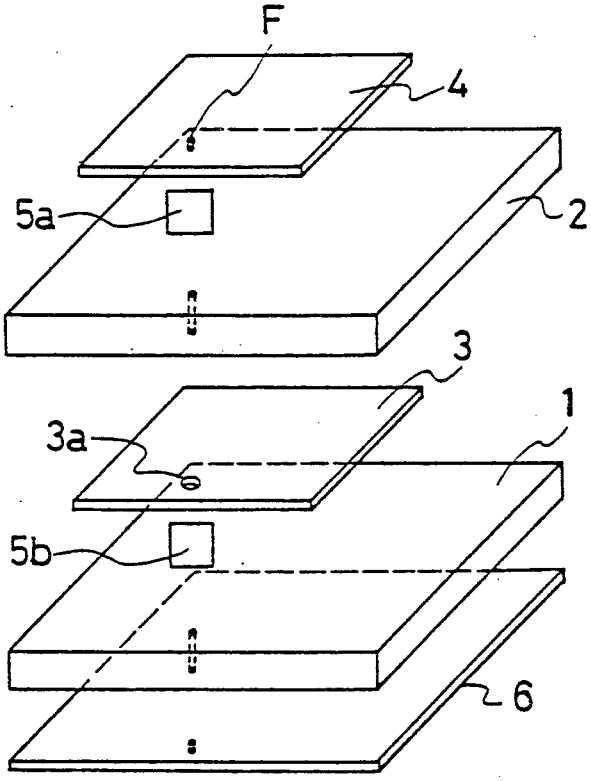
FIG. 2 is an exploded view of FIG. 1 to better illustrate the construction.

FIG. 1 is a perspective view illustrating an embodiment of the present invention, and FIG. 2 is an exploded view of FIG. 1 to better illustrate the construction thereof.

A first radiating element 3 is mounted on a ground plane 6 through a first dielectric layer 1. And a second radiating element 4 is mounted on the first radiating element 3 through a second dielectric layer 2.

They are brought into completely close contact or are placed in close proximity.

By way of example, as a method for obtaining the close contact, one can use pressed bonding with a binder on an insulator, or clamping with a screw which penetrates the first and second dielectric layers 1, 2 somewhat spaced from the edges of the first and second radiating elements 3, 4 and that do not contribute to antenna characteristics, while as a method for obtaining a close proximity, the use of air layer spacers of low permittivity can be considered.

The first radiating element 3 is short-circuited to the ground plane 6 through a copper plate (or copper foil) **5*b* by soldering. And the second radiating element 4 is short-circuited to the first radiating element 3 through a copper plate (or copper foil) 5*a*** by soldering.

Further, a feeding unit having a coaxial line 7 and a connector pin 8 are mounted. In this case, the first radiating element 3 is provided with a hole **3*a* so that the connector pin 8** may become out of electrical contact.

In this stacked microstrip antenna, since power is fed to a feeding point F by the feeding unit, a coupling arises between the first and second radiating elements 3, 4. So that double-channel duplex is realized.

By the way, a dimension from the end of the radiating element to the end of the dielectric layer can be reduced down to a dimension which is nearly equal to the combined thickness h of the first and second dielectric layer 1, 2.

Besides, although the copper plates **5*a*, 5*b* are depicted as separate members in FIG. 2 they may well be formed as being unitary with corresponding the first and second radiating elements 3, 4 or the ground plane 6**.

As a practical example, the stacked microstrip antenna which has two resonance frequencies of 3.68 [GHz] and 4.61 [GHz] is obtained under the fabricating conditions of $a_1 \times b_1 = 7.2(mm) \times 14.4(mm)$, $a_2 \times b_2 = 6.5(mm) \times 13.0(mm)$, $h = 1.2(mm)$, $l_1 = l_2$ and $l_1/b_2 = 0.3$ with the first and second dielectric layers 1,2 of $\epsilon r = 2.55$.

Figure 3:
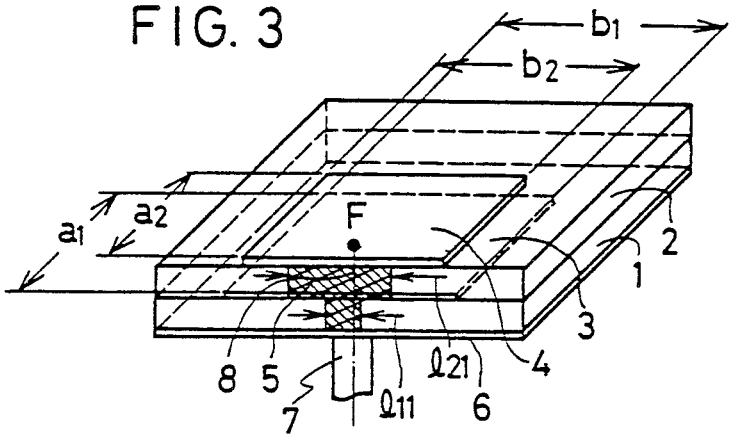
FIG. 3 is a perspective view illustrating an alternate embodiment of the present invention.

FIG. 3 is a perspective view illustrating an alternate embodiment of the present invention.

The stacked microstrip antenna shown in FIG. 3 is an example in which the widthwise dimension $l_{11}$ of the copper plate 5*b* is smaller, while the widthwise dimension $l_{21}$ of the copper plate 5*a* is larger. When the antenna is thus constructed, the resonance frequency $f_2$ of the second radiating element 4 becomes higher than the resonance frequency $f_1$ of the first radiating element 3. With such a construction, even when the dimensions of the first and second radiating elements 3, 4 are equal as $a_1 = a_2$ and $b_1 = b_2$ by way of example, the resonance frequencies $f_1$, $f_2$ take unequal values, and the double-channel duplex of the antenna is realized.

Figure 4:
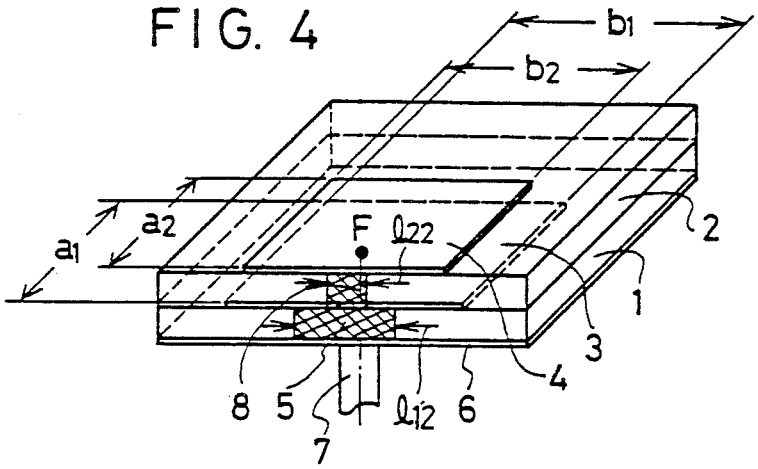
FIG. 4 is a perspective view illustrating an alternate embodiment of the present invention.

FIG. 4 is a perspective view illustrating an alternate embodiment of the present invention.

The stacked microstrip antenna shown in FIG. 4 is an example in which the widthwise dimension $l_{12}$ of the copper plate 5*b* is larger, while the widthwise dimension $l_{22}$ of the copper plate 5*a* is smaller. When the antenna is thus constructed, the resonance frequency $f_1$ of the first radiating element 3 becomes higher than the resonance frequency $f_2$ of the second radiating element 4. With such a construction, even when the dimensions of the first and second radiating elements 3, 4 are equal as $a_1 = a_2$ and $b_1 = b_2$ by way of example, the resonance frequencies $f_1$, $f_2$ take unequal values, and the double-channel duplex of the antenna is realized.

In this manner, by changing the individual widthwise dimensions of the short-circuiting conductors, the resonance frequencies $f_1$, $f_2$ can be controlled, and the double-channel duplex of the antenna is permitted. In addition, it is effective adjustment means for attaining desired resonance frequencies.

Figure 5:
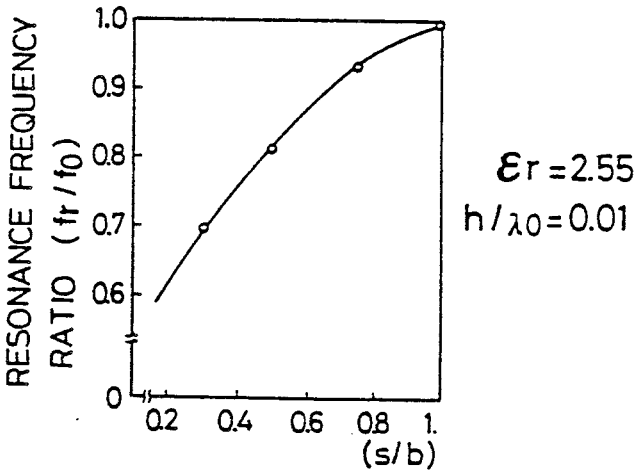
FIG. 5 is a diagram illustrating the variation of a resonance frequency corresponding to changing the widthwise dimension of a short-circuiting conductor.

FIG. 5 illustrates the variation of a resonance frequency in the case where the widthwise dimension of a short-circuiting conductor was changed in a stacked microstrip antenna shown in FIG. 1 which had the first and second dielectric layers 1, 2 of a relative dielectric constant $\epsilon r = 2.55$ and the original frequency to corresponding to the whole edge short-circuiting and in which, letting h denote the combined thickness of the first and second dielectric layers 1, 2 and $\lambda o$ denote the wavelength in the free space, $h/\lambda o$ = approximately 0.01 held.

It is understood from FIG. 5 that, letting S denote the widthwise dimension of the short-circuiting conductor and b denote the dimension of the edges of the first and second radiating elements 3,4 in tough with the short-circuiting conductors, the resonance frequency for $s/b = 0.3$ becomes at least about 30% lower than the resonance frequency for $s/b = 1.0$ corresponding to the whole edge short-circuiting. Usually, the size of the radiating element is proportional to the wavelength, and it enlarges more as the resonance frequency becomes lower. In view of the above result, however, the resonance frequency could be lowered in spite of the radiating element size of higher resonance frequency. That is, reduction in the size of the radiating element was achieved.

Figure 6:
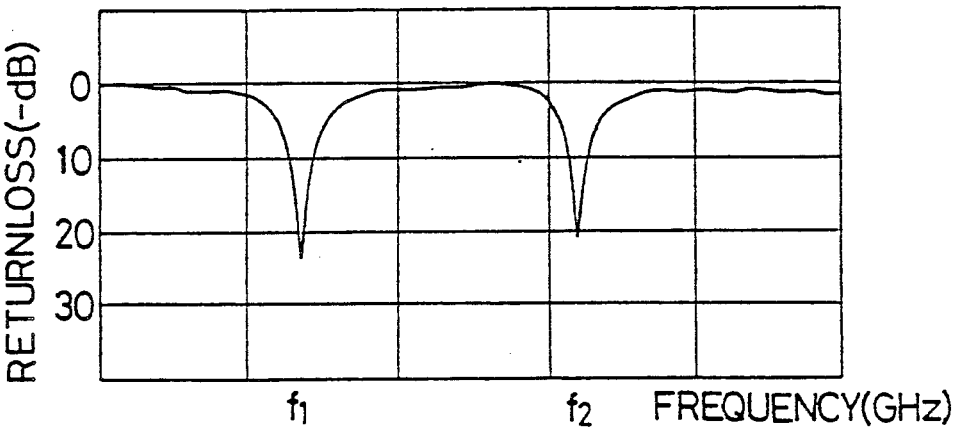
FIG. 6 is a diagram illustrating return loss characteristics of a stacked microstrip antenna shown in FIG. 1.

FIG. 6 is a diagram illustrating return loss characteristics of the stacked microstrip antenna shown in FIG. 1.

FIG. 6 was measured on condition that the widthwise dimensions $l_1$, $l_2$ of the short-circuiting conductors were equalized, $l_1/b_2 = 0.3$ was held, and $h/\lambda o$ = at least 0.01 was held.

A frequency interval $f_1$-$f_2$ is substantially constant and the resonance frequencies shift into a lower frequency region, when the widthwise dimensions of the short-circuiting conductors are reduced.

Figure 7:
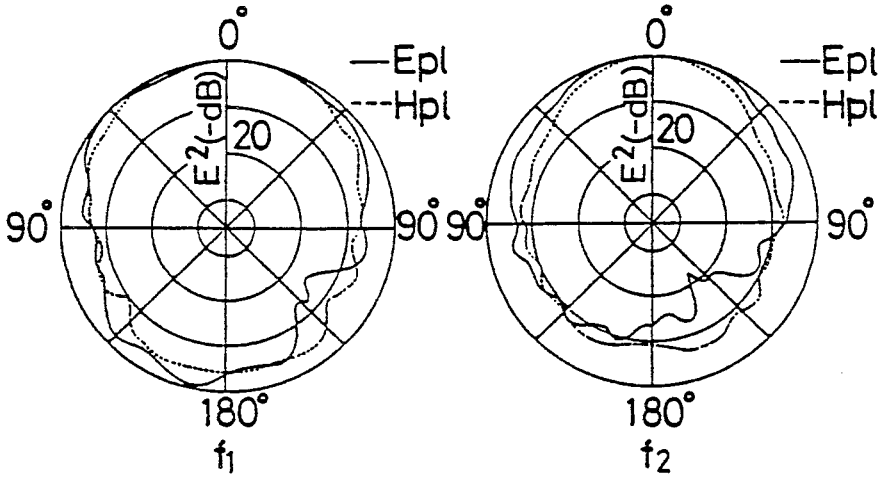
FIG. 7 is a diagram illustrating radiation pattern characteristics of a stacked microstrip antenna shown in FIG. 1.

FIG. 7 is a diagram illustrating radiation pattern characteristics of the stacked microstrip antenna shown in FIG. 1.

The radiation pattern characteristics shown in FIG. 7 indicate that the antenna can put to practical use.

Figure 8:
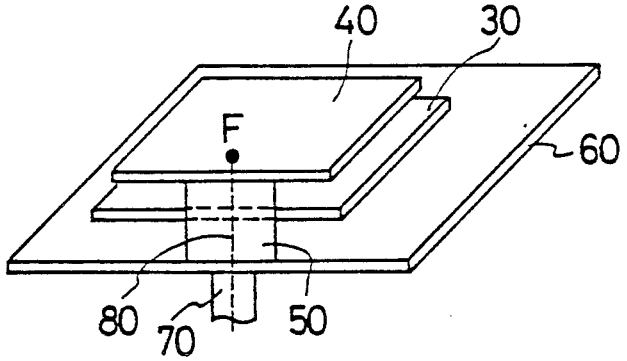
FIG. 8 is a perspective view illustrating an alternate embodiment of the present inventions.

FIG. 8 is a perspective view illustrating an alternate embodiment of the present invention.

A ground plane 60 and a first radiating element 30 are opposed with a predetermined space defined therebetween, a second radiating element 40 is further opposed over the first radiating element 30 with a predetermined space defined therebetween, and the ground plane 60 and the first and second radiating elements 30, 40 are short-circuited by a short-circuiting conductor 50. A coaxial line 70 is connected to the ground plane 60, and the second radiating element 40 is fed with power by a connector pin 80. On this occasion, the first radiating element 30 and the connector pin 80 are held in an electrically non-contacting state. Even the stacked microstrip antenna in which the dielectric layers are replaced with the air layers in this manner, achieves the effect of the present invention.

The gain of the miniature microstrip antenna of the present invention is proportional to an open area likewise to that of the conventional microstrip antenna.

Although the shape of each radiating element has been square in the present invention, it may well be another shape, for example, a circular or elliptical shape.

As described above, according to a construction based on the present invention, an antenna of lower frequencies can be realized with dimensions equal to those of an antenna of higher frequencies.

That is, the antenna becomes smaller in size, so it can be readily built in the casing of a radio communication apparatus.

What is claimed is:

1. A stacked microstrip antenna comprising:

a ground plane;

a first dielectric layer formed on said ground plane;

a first radiating element formed on said first dielectric layer;

a second dielectric layer formed on said first radiating element;

a second radiating element formed on said second dielectric layer;

short-circuiting means disposed along side planes of said first and second dielectric layers for short-circuiting said ground plane, said first radiating element and said second radiating element, said short-circuiting means comprising a first short-circuiting means for short-circuiting said ground plane and said first radiating element, and a second short-circuiting means for short-circuiting said first radiating element and said second radiating element, and wherein a widthwise dimension of said first short-circuiting means is narrower than a widthwise dimension of said second short-circuiting means; and feeding means for feeding a power to said ground plane and one of said first and second radiating elements.

2. A stacked microstrip antenna comprising: means defining a ground plane; a first dielectric layer on the ground plane and having a first side plane; a first radiating element on the first dielectric layer; a second dielectric layer on the first radiating element and having a second side plane; a second radiating element on the second dielectric layer; and means short-circuiting the ground plane to the first and second radiating elements disposed on the first and second side planes of the first and second dielectric layers, said short-circuiting means comprising a first short-circuiting element for short-circuiting said ground plane and said first radiating element, and a second short-circuiting element for short-circuiting said first radiating element and said second radiating element, and wherein a widthwise dimension of said first short-circuiting element is narrower than a widthwise dimension of said second short-circuiting element.

* * * * *